US005963171A

United States Patent [19]

Jones

[11] Patent Number: 5,963,171

[45] Date of Patent: Oct. 5, 1999

[54] THERMALLY INSULATED SATELLITE REFLECTOR ASSEMBLY WITH NON-EMBEDDED HEATER ASSEMBLY

[75] Inventor: Thaddeus M. Jones, Bremen, Ind.

[73] Assignee: MSX, Inc., South Bend, Ind.

[21] Appl. No.: 08/852,517

[22] Filed: May 7, 1997

[51] Int. Cl.[6] ..... H01Q 1/02

[52] U.S. Cl. ..... 343/704; 343/912

[58] Field of Search ..... 343/704, 840, 343/912, 915; H01Q 1/02, 1/12

[56] References Cited

U.S. PATENT DOCUMENTS

| | | | |
|---|---|---|---|
| 2,679,003 | 5/1954 | Dyke et al. | 250/33.65 |
| 3,674,215 | 7/1972 | Erdmann | 239/548 |
| 4,195,302 | 3/1980 | Leupelt | 343/704 |
| 4,259,671 | 3/1981 | Levin | 343/704 |
| 4,368,471 | 1/1983 | Walton, Jr. | 343/704 |
| 4,536,765 | 8/1985 | Kaminski | 343/704 |
| 4,866,452 | 9/1989 | Barma et al. | 343/704 |
| 5,010,350 | 4/1991 | Lipkin et al. | 343/704 |
| 5,353,037 | 10/1994 | Jones | 343/704 |
| 5,401,573 | 3/1995 | Babel et al. | 428/336 |

FOREIGN PATENT DOCUMENTS

| | | | |
|---|---|---|---|
| 645235 | 10/1950 | European Pat. Off. | 38/40 |
| 0208703 | 12/1982 | Japan | 343/704 |
| 57-207402 | 12/1982 | Japan | H01Q 1/02 |
| 57-208702 | 12/1982 | Japan | H01Q 1/02 |
| 60-214604 | 10/1985 | Japan | H01Q 1/02 |
| 0193503 | 8/1986 | Japan | H01Q 1/02 |
| 1-254003 | 10/1989 | Japan | H01Q 1/12 |
| 0044803 | 2/1990 | Japan | H01Q 1/02 |
| 405037215 | 2/1993 | Japan | H01Q 1/02 |

*Primary Examiner*—Don Wong
*Assistant Examiner*—Tho Phan
*Attorney, Agent, or Firm*—Taylor & Associates, P.C.

[57] ABSTRACT

A reflector assembly in a satellite system includes a reflector having a reflecting surface and a back surface. The back surface is opposite the reflecting surface and has a plurality of ribs extending transversely therefrom. The reflector assembly further includes a layer of air-entrapped foam insulation having an inside surface. The inside surface has a plurality of grooves configured to receive the plurality of ribs therein. The reflector assembly further includes a heater assembly attached to the inside surface of the layer of air-entrapped foam insulation. The heater assembly includes a plurality of heater pads, a plurality of jumper wires electrically interconnecting the heater pads in series, and two end wires. Each end wire is connected to a respective end one of the heater pads. Each of the plurality of heater pads is disposed between a corresponding adjacent pair of the grooves. The reflector assembly further includes an adhesive layer covering substantially all of each one of the plurality of heater pads and interconnecting the heater assembly with the back surface of the reflector.

23 Claims, 3 Drawing Sheets

THERMALLY INSULATED SATELLITE REFLECTOR ASSEMBLY WITH NON-EMBEDDED HEATER ASSEMBLY

BACKGROUND OF THE INVENTION

1. Field of the Invention

The present invention relates to satellite systems, and, more particularly, reflectors for satellite systems.

2. Description of the Related Art

A reflector, commonly called a dish, is generally a parabolic section having a round, elliptical or other configuration. A reflector functions to gather radio or microwave frequency energy transmitted from the feedhorn or through the ambient environment from an external transmitter. The reflector can thus be used to receive and transmit signals to and from the satellite system. Reflectors are usually located outdoors, where snow and ice may collect on the receiving or concave side, degrading the performance of the reflector.

It is known to heat the front receiving surface of the reflector with an embedded heater wire. A problem with embedding a heater wire within a reflector is that it can be difficult or even impossible to repair the heater wire in the event that the heater wire is damaged during or after the embedding process. Another problem is that the decision to install a heater wire must be made before manufacture of the reflector. Often this decision must be made before it is known whether the reflector will be located in a climate sufficiently cold that a heater wire is required.

What is needed in the art is a reflector assembly for a satellite system including a heater assembly which inhibits or melts snow or ice accumulation on the reflecting surface of the reflector, can be easily installed after manufacture of the reflector, and can also be easily repaired.

SUMMARY OF THE INVENTION

The present invention provides a reflector assembly in a satellite system including a heater assembly attached to a molded, air-entrapped foam layer of insulation. The heater assembly is adhered to a back surface of the reflector such that the heater assembly can be easily repaired, replaced or installed.

The invention comprises, in one form thereof, a reflector assembly in a satellite system including a reflector having a reflecting surface and a back surface. The back surface is opposite the reflecting surface and has a plurality of ribs extending transversely therefrom. The reflector assembly further includes a layer of air-entrapped foam insulation having an inside surface. The inside surface has a plurality of grooves configured to receive the plurality of ribs therein. The reflector assembly further includes a heater assembly attached to the inside surface of the layer of air-entrapped foam insulation. The heater assembly includes a plurality of heaters such as heater pads, a plurality of jumper wires electrically interconnecting the heater pads in series, and two end wires. Each end wire is connected to a respective end one of the series connected heater pads. Each of the plurality of heater pads is disposed between a corresponding adjacent pair of the grooves. The reflector assembly further includes an adhesive layer covering substantially all of each one of the plurality of heater pads and interconnecting the heater assembly with the back surface of the reflector.

An advantage of the present invention is that the heater assembly may be installed on the reflector as an after-market item. Thus, it is unnecessary to decide during manufacture whether to embed a heater wire into a particular reflector.

Another advantage is that the layer of air-entrapped foam insulation may be molded to conform to the back surface of any particular reflector, and thereby provide easy installation of the attached heater assembly on the corresponding reflector.

Yet another advantage is that in the event that the heater assembly becomes damaged, it can easily be removed from the back surface of the reflector for repair or replacement. The heater assembly can also be removed from the inside surface of the layer of air-entrapped foam insulation for replacement and reinstallation.

BRIEF DESCRIPTION OF THE DRAWINGS

The above-mentioned and other features and advantages of this invention, and the manner of attaining them, will become more apparent and the invention will be better understood by reference to the following description of an embodiment of the invention taken in conjunction with the accompanying drawings, wherein.

Corresponding reference characters indicate corresponding parts throughout the several views. The exemplifications set out herein illustrate one preferred embodiment of the invention, in one form, and such exemplifications are not to be construed as limiting the scope of the invention in any manner.

DETAILED DESCRIPTION OF THE INVENTION

Figure 1:
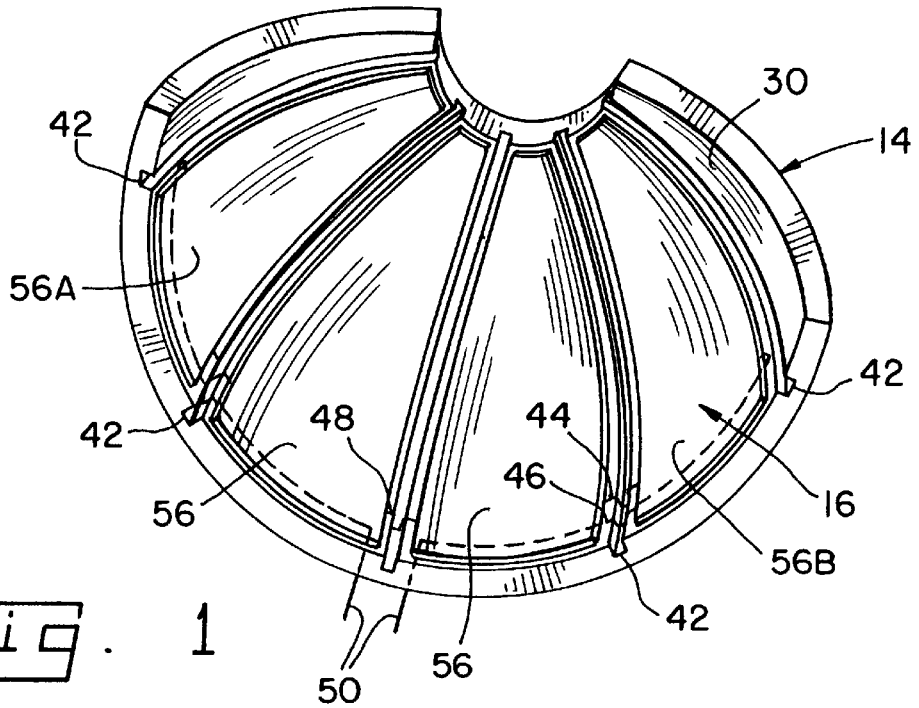
FIG. 1 is a front, perspective view of one embodiment of the present invention showing a heater assembly attached to the inside surface of a layer of air-entrapped foam insulation.
Figure 2:
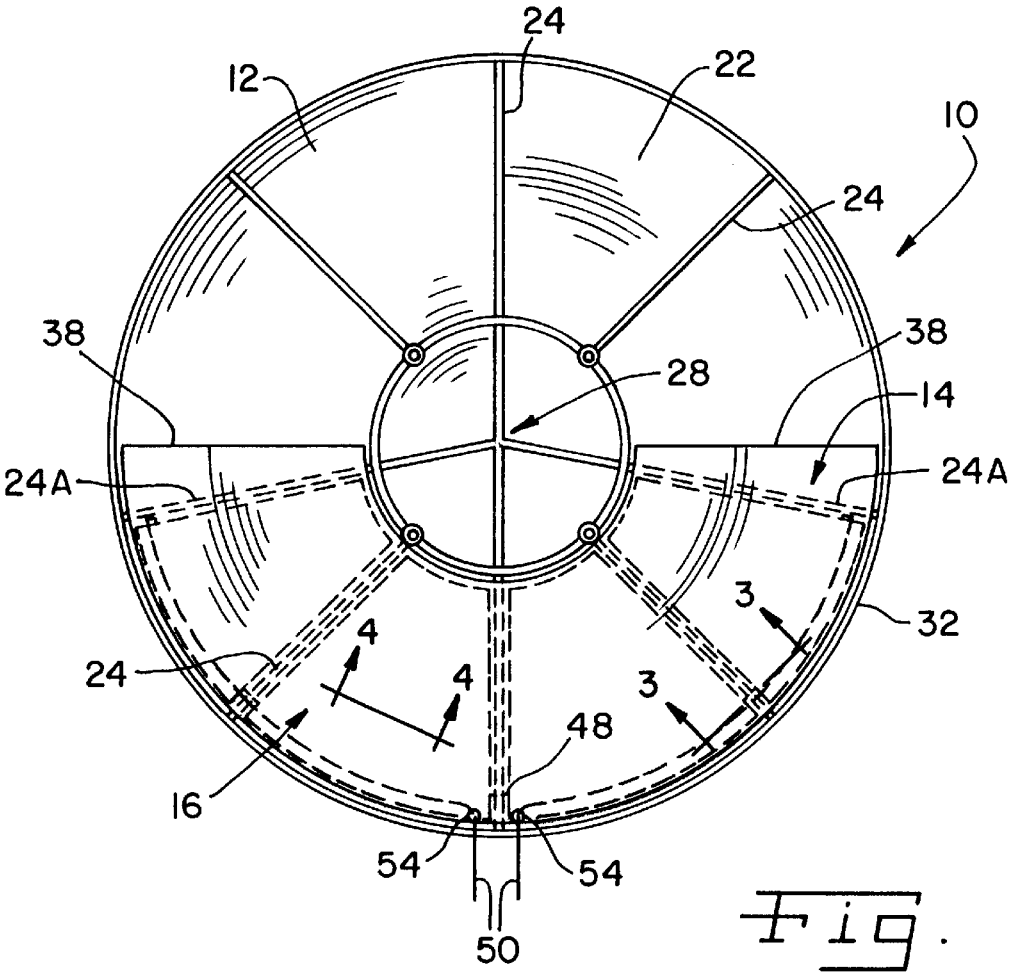
FIG. 2 is a rear view of one embodiment of a reflector assembly of the present invention, including the heater assembly and layer of insulation shown in FIG. 1.

Referring now to the drawings, and more particularly to FIG. 2, there is shown a reflector assembly 10 including a reflector 12, a layer of insulation 14, a heater assembly 16 and an adhesive layer 18.

Reflector 12 includes a reflecting surface 20 (FIGS. 2 and 3) having a desired curvature for the specific application for which reflector assembly 10 is to be utilized. For example, reflecting surface 20 may have a concave parabolic curvature with a circular or elliptical shaped perimeter. Reflecting surface 20 reflects radio or microwave frequency energy transmitted from a feedhorn or another external source (not shown).

Reflector 12 also includes a back surface 22 having a plurality of ribs 24 extending transversely therefrom. Ribs 24 each have a height (perpendicular to back surface 22) of approximately two inches in the embodiment shown and provide structural support to reflector 12. Ribs 24 are shown as predominantly extending radially outward from center 28 on back surface 22. However, it is to be understood that ribs 24 can be arranged in many different configurations.

Layer of insulation 14 (FIGS. 1–4) is fabricated from a layer of air-entrapped foam insulation such as closed cell plastic foam, preferably polystyrene, and is relatively rigid.

Inside surface 30 of insulation 14 is disposed adjacent to back surface 22 of reflector 12. Within the small gap, e.g., 1/16 inch, between inside surface 30 and back surface 22 (FIG. 4) lies heater assembly 16 and an adhesive layer 18, to be described in more detail below.

Insulation 14 covers heater assembly 16 and back surface 22 of reflector 12, inhibiting heat loss to the ambient environment. Insulation 14, in the embodiment shown in FIGS. 2–4, substantially covers only bottom half 32 of back surface 22, corresponding to the placement of heater assembly 16 on back surface 22 of reflector 12. Additionally, in the embodiment shown, insulation 14 extends approximately one inch above and covers substantially horizontal ribs 24A to prevent an unacceptable amount of heat loss therefrom. Horizontal ribs 24A separate top half 36 and bottom half 32 of back surface 22. A top edge 38 of insulation 14 is adhered and sealed to back surface 22 with an appropriate sealant, defining a substantially waterproof seal therebetween which prevents water and debris from falling between inside surface 30 of insulation 14 and back surface 22 of reflector 12. The waterproof seal also prevents heat loss from convection currents rising out from between insulation 14 and reflector 12.

Figure 3:
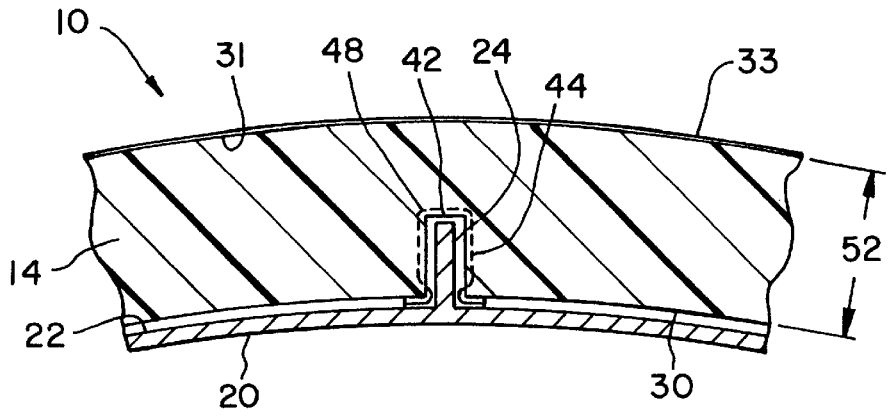
FIG. 3 is a fragmentary, sectional view of the reflector assembly shown in FIG. 2 taken along line 3—3.
Figure 4:
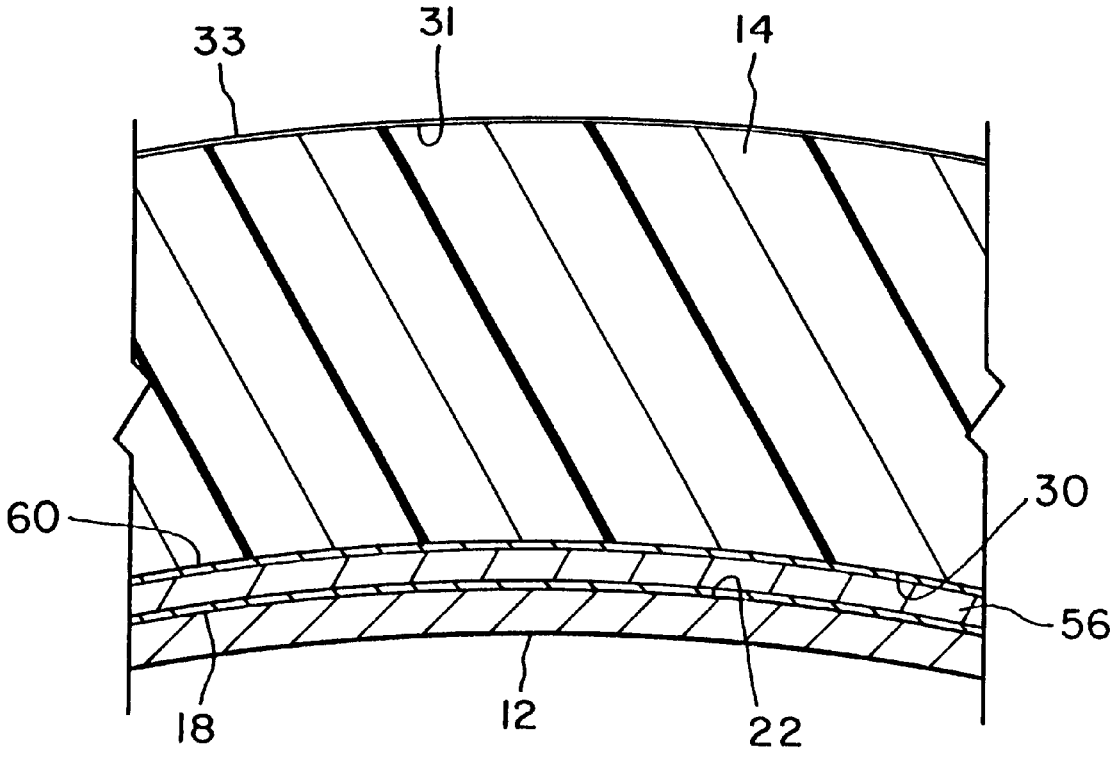
FIG. 4 is an enlarged, fragmentary, sectional view of the reflector assembly shown in FIG. 2 taken along line 4—4.

Insulation 14 includes an inside surface 30 and and outside surface 31. Outside surface 31 may be coated with a coating of ultraviolet radiation protectant 33 (FIGS. 3 and 4). Inside surface 30 of insulation 14 includes a plurality of grooves 42 (FIG. 1), each of which is configured to receive a corresponding one of ribs 24. Grooves 42 are contoured to be placed around corresponding ribs 24 to retain as much heat as possible within ribs 24. A number of grooves 42 have an inner channel 44 and outer channel 46 further recessing into inside surface 30 of insulation 14. Channels 44 and 46 are disposed perpendicularly relative to the length of grooves 42. Inner channel 44 and outer channel 46 are configured to respectively receive a jumper wire 48 and an end wire 50 from heater assembly 16. Channels 44 and 46 prevent ribs 24 from pressing into and/or possibly shorting out wires 48 and 50. Insulation 14 has a thickness 52 of between approximately four and five inches in the embodiment shown, and thus extends between approximately two and three inches past ribs 24 in a direction transverse to back surface 22.

Insulation 14 also includes two through holes 54. Each of heater wire ends 50 extend through a corresponding one of through holes 54 so that ends 50 can be connected to an external power source (not shown).

Heater assembly 16 includes a heating device in the form of a plurality of heater pads 56, each of which is disposed between a pair of adjacent grooves 42 on inside surface 30 of insulation 14. Heater pads 56 are electrically connected in series by jumper wires 48 in the embodiment shown. The two end wires 50 are each connected to a corresponding end heater pad 56A and 56B and extend through a corresponding through hole 54 in insulation 14. End wires 50 interconnect end heater pads 58 with a power source (not shown) which sources power through heater assembly 16, causing the temperature of heater assembly 16 to rise. Heater pads 56 can be formed of sheets of aluminum or any thermally and electrically conductive material. Jumper wires 48 and end wires 50 can be electrically connected to heater pads 56 by any of a number of methods including soldering, riveting and crimping.

Heater assembly 16 can be attached to inside surface 30 of insulation 14 with any of several devices including staples, adhesive tape, or, as shown in FIG. 4, a layer of adhesive 60.

Figure 5:
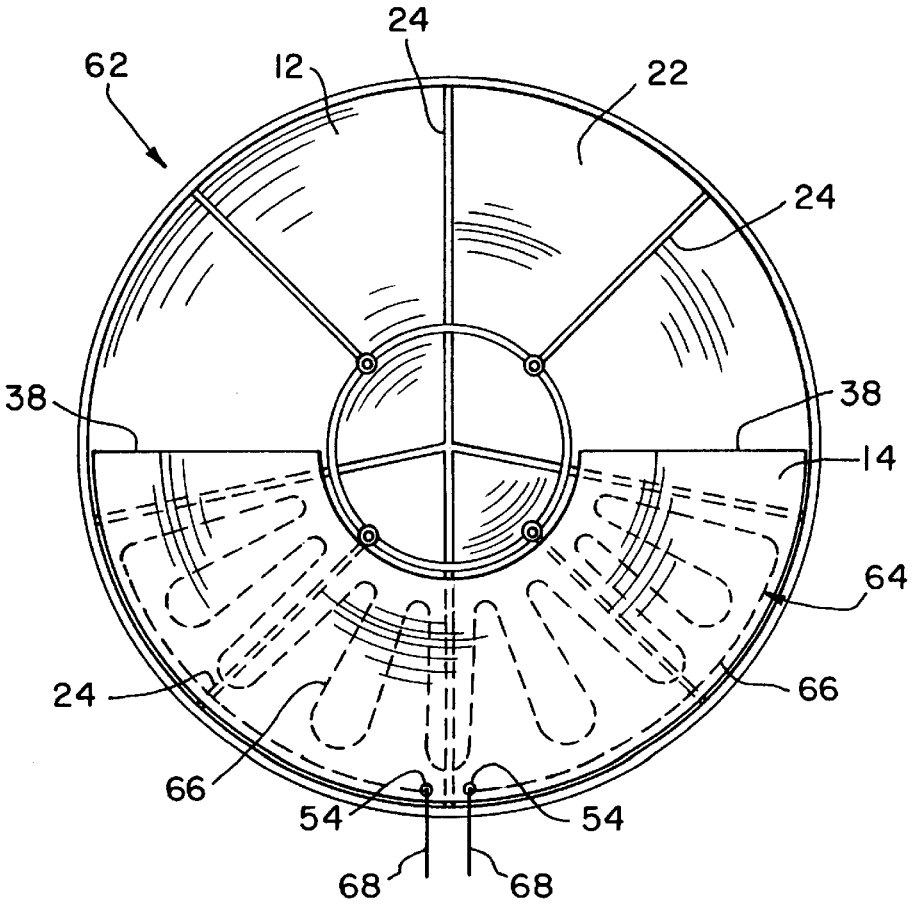
FIG. 5 is a rear view of another embodiment of a reflector assembly of the present invention.

Adhesive layer 18 interconnects heater pads 56 with bottom half 32 of back surface 22 of reflector 12 (FIG. 5). Adhesive layer 18 can be fabricated of silicone rubber or other elastomeric materials. However, any substance that is suitably adhesive and thermally conductive, such as wax, can also be used. The adhesive is preferably selected with a material having a melting temperature which is less than the melting temperature of the material from which reflector 12 is constructed. For example, a wax having a melting point of not greater than approximately 80° Celsius can advantageously be used in conjunction with a layer of insulation 14 that is molded of a high temperature material, such as closed cell polyurethane. A sufficient amount of electrical power can be applied to heater assembly 16 to melt the wax and thereby adhere heater assembly 16 with reflector 12 upon cooling and solidification of the wax. Alternatively, adhesive layer 18 can be formed of more than one substance. For example, adhesive layer 18 can be formed of a highly thermally conductive substance, such as a silicone oxide, in the middle portions of heater pads 56, while being formed of a more adhesive substance, such as silicone rubber, in strips along the outer portions of heater pads 56.

Referring now to FIG. 5, another embodiment of a reflector assembly 62 includes a heater assembly 64 with a single continuous heater wire 66 disposed in a zig-zag manner between grooves 42 on inside surface 30 of layer of insulation 14, the zig-zag portions being joined by short segments crossing grooves 42. Heater assembly 64 has two end wires 68, each of which extends through one of two through holes 54 in layer of insulation 14 and connects to a power source (not shown).

During use, the external power source sources power through heater assembly 16, heating heater pads 56. This heat transfers through adhesive layer 18 and reflector 12 to reflecting surface 20, melting any accumulated ice and/or snow. The heat also hastens the evaporation of any water on reflecting surface 20. Insulation 14 improves the heat transfer efficiency of reflector assembly 10 by inhibiting heat transfer from back surface 22 of reflector 12. Waterproof seal 40 inhibits precipitation from entering and heat from exiting between inside surface 30 of insulation 14 and back surface 22 of reflector 12. During manufacture, heater assembly 16 is attached to layer of insulation 14 by any of a number of methods, including stapling and gluing. Heater wire ends 50 are each threaded through a corresponding one of two through holes 54 in layer of insulation 14. Heater assembly 16 and layer of insulation 14 can be installed onto reflector 12 either at the factory or in the field after the need for reflector heating has been determined. Each of heater pads 56 is substantially covered with a layer of adhesive 18. Before adhesive layer 18 has time to set, heater assembly 16 is clamped against back surface 22 of reflector 12 such that substantially all air gaps therebetween are squeezed out. During the curing process of adhesive layer 18, heater assembly 16 becomes adhered to back surface 22.

Also during manufacture, insulation 14 is molded to include grooves 42 within inside surface 30 of insulation 14 which closely match ribs 24 of reflector 12. Inside surface 30 is molded with a shape and size which substantially conforms to back surface 22 of reflector 12. Insulation 14 may be molded using conventional molds and molding techniques. However, it is also possible to use at least a portion of a reflector as a mold half which is coupled with a mating mold half such that the closed cell plastic foam insulation may be injected therebetween.

In the embodiment shown in FIGS. 1–4, heater pads 56 are connected in series using jumper wires. However, heater assembly 16 could be constructed in ways other than as shown in the drawings. For example, heater pads 56 could be electrically interconnected not by jumper wires, but rather by one continuous heater wire, the ends of which are connected to a power source.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A reflector assembly in a satellite system, comprising:

a reflector including a reflecting surface and a back surface, said back surface opposite said reflecting surface, said back surface having a plurality of ribs extending transversely therefrom;

a layer of air-entrapped foam insulation including an inside surface having a plurality of grooves, said plurality of grooves configured to receive said plurality of ribs therein;

a heater assembly attached to said inside surface of said layer of air-entrapped foam insulation, said heater assembly including a plurality of heater pads and a plurality of jumper wires electrically interconnecting said heater pads in series, each of said plurality of heater pads being disposed between a corresponding adjacent pair of said grooves; and an adhesive layer covering substantially all of each one of said plurality of heater pads and interconnecting said heater assembly with said back surface of said reflector.

2. The reflector assembly of claim 1, wherein said adhesive layer defines a means for substantially eliminating air gaps between said heater pads and said back surface of said reflector.

3. The reflector assembly of claim 1, wherein said adhesive layer is comprised of an elastomeric material.

4. The reflector assembly of claim 3, wherein said elastomeric material comprises silicone rubber.

5. The reflector assembly of claim 1, wherein said adhesive layer comprises wax.

6. The reflector assembly of claim 1, wherein said adhesive layer has a melting temperature which is less than a melting temperature of said layer of insulation.

7. The reflector assembly of claim 6, wherein said adhesive has a melting temperature of not greater than approximately 80° Celsius and said layer of air-entrapped foam insulation comprises a layer of closed cell polyurethane.

8. The reflector assembly of claim 1, wherein said layer of air-entrapped foam insulation comprises a layer of polystyrene foam.

9. The reflector assembly of claim 1, wherein said plurality of heater pads include two end heater pads, said heater assembly further comprising two end wires respectively connected with said end heater pads, said two end wires extending through said layer of air-entrapped foam insulation.

10. The reflector assembly of claim 9, wherein said layer of air-entrapped foam insulation has two through holes, each of said two end wires extending through a corresponding one of said two through holes.

11. The reflector assembly of claim 10, manufactured by a process comprising the steps of:

threading each of said end wires through a corresponding one of said two through holes;

attaching said heater assembly to said inside surface of said layer of air-entrapped foam insulation;

applying said adhesive to said heater pads; and pressing said inside surface of said layer of air-entrapped foam insulation against said back surface of said reflector such that substantially all air between said heater pads and said back surface of said reflector is eliminated.

12. The reflector assembly of claim 1, manufactured by a process comprising the steps of:

attaching said heater assembly to said inside surface of said layer of air-entrapped foam insulation;

applying adhesive to said heater pads; and pressing said inside surface of said layer of air-entrapped foam insulation against said back surface of said reflector such that substantially all air between said heater pads and said back surface of said reflector is eliminated.

13. The reflector assembly of claim 1, wherein said heater assembly is adhered to said inside surface of said layer of air-entrapped foam insulation.

14. The reflector assembly of claim 1, wherein said adhesive layer is thermally conductive.

15. The reflector assembly of claim 1, wherein said layer of air-entrapped foam insulation is rigid.

16. The reflector assembly of claim 1, manufactured by a process comprising the step of molding said layer of air-entrapped foam insulation to include said plurality of grooves in said inside surface.

17. The reflector assembly of claim 1, wherein said reflector includes a top half and a bottom half, said adhesive layer interconnecting said heater assembly only with said bottom half of said reflector.

18. The reflector assembly of claim 1, wherein said layer of air-entrapped foam insulation includes a top edge, and further comprising a sealant disposed between said top edge and said back surface, said sealant, said top edge and said back surface defining a substantially waterproof seal.

19. The reflector assembly of claim 1, wherein said inside surface of said layer of air-entrapped foam insulation has a plurality of channels, each said channel being configured for receiving a corresponding one of said jumper wires therein.

20. A reflector assembly in a satellite system, comprising:

a reflector including a reflecting surface and a back surface, said back surface opposite said reflecting surface, said back surface having a plurality of ribs extending transversely therefrom;

a continuous layer of air-entrapped foam insulation including an inside surface and a plurality of grooves, said plurality of grooves being configured to receive said plurality of ribs therein;

a heater assembly including a heating device attached to said inside surface of said layer of air-entrapped foam insulation, said heating device comprising a plurality of heater pads, each of said plurality of heater pads being disposed between a corresponding adjacent pair of said grooves; and an adhesive layer covering substantially all of said heating device and interconnecting said heating device with said back surface of said reflector.

21. The reflector assembly of claim 20, wherein said layer of insulation includes an outside surface and a coating of ultraviolet radiation protectant disposed over said outside surface.

22. An assembly for attachment to a back surface of a reflector in a satellite system, the back surface including a plurality of ribs extending transversely therefrom, said assembly comprising:

a layer of air-entrapped foam insulation including an inside surface having a plurality of grooves, said plurality of grooves configured to receive the plurality of ribs therein; and a heater assembly including a heating device attached to said inside surface of said layer of air-entrapped foam insulation, said heating device comprising a plurality of heater pads, said heater assembly further comprising a plurality of jumper wires electrically interconnecting said heater pads in series, and two end wires, each said end wire connected to a respective end one of said heater pads, each of said plurality of heater pads being disposed between a corresponding adjacent pair of said grooves.

23. A reflector assembly in a satellite system, comprising:

a reflector including a reflecting surface and a back surface, said back surface opposite said reflecting surface, said back surface having a plurality of ribs extending transversely therefrom;

a layer of air-entrapped foam insulation including an inside surface having a plurality of grooves, said plurality of grooves configured to receive said plurality of ribs therein;

a heater assembly attached to said inside surface of said layer of air-entrapped foam insulation, said heater assembly including a plurality of heaters and a plurality of jumper wires electrically interconnecting said heaters, each of said plurality of heaters being disposed between a corresponding adjacent pair of said grooves; and an adhesive layer covering substantially all of each one of said plurality of heaters and interconnecting said heater assembly with said back surface of said reflector.

* * * * *